US010391620B2

(12) United States Patent
Yang et al.

(10) Patent No.: US 10,391,620 B2
(45) Date of Patent: Aug. 27, 2019

(54) BASE MECHANISM AND ROLLER MECHANISM OF FLOOR NAILING GUN

(71) Applicant: TAIZHOU DAJIANG IND. CO., LTD., Wenling, Zhejiang Province (CN)

(72) Inventors: Ming-Jun Yang, Wenling (CN); Zai-Jun Zhu, Wenling (CN)

(73) Assignee: TAIZHOU DAJIANG IND. CO., LTD., Wenling, Zhejiang Province (CN)

( * ) Notice: Subject to any disclaimer, the term of this patent is extended or adjusted under 35 U.S.C. 154(b) by 401 days.

(21) Appl. No.: 15/206,694

(22) Filed: Jul. 11, 2016

(65) Prior Publication Data

US 2017/0259419 A1 Sep. 14, 2017

(30) Foreign Application Priority Data

Mar. 8, 2016 (CN) ..... 2016 1 0130124
Mar. 8, 2016 (CN) ..... 2016 1 0130848
Mar. 8, 2016 (CN) ..... 2016 2 0175966 U
Mar. 8, 2016 (CN) ..... 2016 2 0175982 U

(51) Int. Cl.
*B25C 7/00* (2006.01)
*B25C 1/04* (2006.01)
*E04F 21/22* (2006.01)

(52) U.S. Cl.
CPC ..... *B25C 7/00* (2013.01); *B25C 1/04* (2013.01); *E04F 21/22* (2013.01)

(58) Field of Classification Search
CPC ..... B25C 7/00; B25C 7/006; E04F 21/22
See application file for complete search history.

(56) References Cited

U.S. PATENT DOCUMENTS 7,255,256 B2 * 8/2007 McGee ..... B25C 1/041 227/119
7,721,817 B2 * 5/2010 McGee ..... B25C 7/00 173/31
2003/0166386 A1 * 9/2003 McDonald ..... B24B 23/005 451/360
2003/0213829 A1 * 11/2003 Bruins ..... B25C 5/1693 227/99
2006/0261124 A1 * 11/2006 McGee ..... B25C 7/00 227/130

(Continued)

*Primary Examiner* — Alexander M Valvis
*Assistant Examiner* — Daniel Jeremy Leeds
(74) *Attorney, Agent, or Firm* — Tim Tingkang Xia, Esq.; Locke Lord LLP

(57) ABSTRACT

The invention relates to a base mechanism and a roller mechanism of a floor nailing gun. The base mechanism includes a base fixedly connected to a bottom of a main body of a floor nailing gun. At least one adjustment roller assembly is movably disposed at a front end portion of the base, each adjustment roller assembly includes an adjustment roller having a lowest point in contact with a floor surface when in operation. The roller mechanism includes a base fixedly connected to a bottom of a main body of a floor nailing gun, at least one roller group is disposed at a rear end portion of the base, an elastic reset member is disposed between the roller group and the base, each roller group comprises a roller having a lowest point in contact with a floor surface when the roller is in a normal state.

7 Claims, 15 Drawing Sheets

(56) References Cited

U.S. PATENT DOCUMENTS

| | | | | |
|---|---|---|---|---|
| 2007/0257081 | A1* | 11/2007 | Dion | B25C 1/008 227/148 |
| 2008/0296341 | A1* | 12/2008 | Francescon | B25C 7/00 227/119 |
| 2010/0187282 | A1* | 7/2010 | Crawford | B25C 7/00 227/140 |
| 2010/0252607 | A1* | 10/2010 | Forrest | B25C 1/04 227/8 |
| 2015/0102086 | A1* | 4/2015 | McCardle | B25C 7/00 227/155 |
| 2015/0174749 | A1* | 6/2015 | Liu | B25C 5/1617 227/120 |
| 2017/0259419 | A1* | 9/2017 | Yang | E04F 21/22 |

* cited by examiner

BASE MECHANISM AND ROLLER MECHANISM OF FLOOR NAILING GUN

CROSS-REFERENCE TO RELATED PATENT APPLICATIONS

This application claims priority to and the benefit of Chinese Patent Application Nos. CN201620175982.2, CN201610130124.0, CN201620175966.3, and CN201610130848.5, all filed Mar. 8, 2016 in the State Intellectual Property Office of P.R. China, which are incorporated herein in their entireties by reference.

FIELD OF THE INVENTION

The present invention relates generally to floor nailing gun, and more particularly, to a base mechanism and a roller mechanism of a floor nailing gun, and a floor nailing gun having the same.

BACKGROUND OF THE INVENTION

Currently, floor nailing guns on the market, when in use, need to be lifted up once nailing at a position on a floor, and to be moved to another position for nailing at the another position on the floor. Therefore, not only working efficiency is low, but also working strength is relatively high. In addition, because various different floor manufacturers and different floor specifications cause a relatively large difference of nailing positions of the floor nailing guns, each time prior to the use, accessories of the floor nailing guns need to be replaced so as to adapt to a size of a specification of a floor. When a floor nailing gun is not configured with an accessory meeting a specification of a floor, the tool cannot be used. On the other hand, to improve working efficiency, roller mechanisms are generally added to a contact surface of a floor. Some roller mechanisms have complex structures, and work unstably because of the setback of the complex structures, which mainly because the floor nailing gun has a special working manner, resulting in that the roller mechanism is damaged very easily in a working process and its service life is short.

Therefore, a heretofore unaddressed need exists in the art to address the aforementioned deficiencies and inadequacies.

SUMMARY OF THE INVENTION

One of the objectives of the present invention is to provide a base mechanism for a floor nailing gun, which has high working efficiency, low working strength, and a strong adaptive capability, so as to overcome the aforementioned deficiencies and inadequacies in the conventional floor nailing guns.

In one aspect of the present invention, a base mechanism usable for a floor nailing gun includes a base fixedly connected to a bottom of a main body of a floor nailing gun, where at least one adjustment roller assembly is movably disposed at a front end portion of the base, the adjustment roller assembly includes an adjustment roller, a lowest point of the adjustment roller is in contact with a floor surface when the adjustment roller is working, and a rolling direction of the adjustment roller is to the left or to the right.

In one embodiment, the adjustment roller assembly further includes an adjustment member, and the adjustment roller is connected to the base by using the adjustment member.

In one embodiment, the adjustment member is disposed on a bottom surface, left and right surfaces, or a front side surface of the base by using a hinge pin, and the base is provided with a sleeve adaptive to the hinge pin.

In one embodiment, the adjustment member is an adjustment connecting plate, the adjustment connecting plate is a symmetric member, and the hinge pin passes through a middle portion of the adjustment connecting plate and connects to the sleeve.

In one embodiment, at least one adjustment roller is disposed on the adjustment connecting plate.

In one embodiment, there are two adjustment rollers, and the two adjustment rollers are symmetrically disposed at two ends of the adjustment connecting plate.

In one embodiment, at least one positioning roller is disposed on a rear end portion of the base, and an axis of the positioning roller is mutually perpendicular to an axial lead of the main body of the floor nailing gun.

In one embodiment, the positioning roller is installed on the base by using a bracket.

In one embodiment, there are two positioning rollers, and the two positioning rollers are respectively connected to a left side and a right side of the base.

Another objective of the present invention is to provide a roller mechanism for a floor nailing gun, which has a simple structure, works stably, and has a long service life.

In another aspect of the present invention, a roller mechanism of a floor nailing gun includes a base fixedly connected to a bottom of a main body of a floor nailing gun, at least one roller group is disposed at a rear end portion of the base, an elastic reset member is disposed between the roller group and the base, the roller group includes a roller, and a lowest point of the roller is in contact with a floor surface when the roller is in a normal state.

In one embodiment, the roller is movably disposed on the base by using a bracket, and the roller is disposed at a bottom of the bracket in a rolling manner.

In one embodiment, the base is provided with an installation groove, and the bracket is located in the installation groove.

In one embodiment, the elastic reset member is a reset spring, the reset spring is located in the installation groove, and one end of the reset spring is connected to the base, and the other end is connected to the bracket.

In one embodiment, the bracket is rotatably connected in the installation groove, and the reset spring is transversely disposed between an upper end portion of the bracket and an upper end portion of the installation groove.

In one embodiment, the upper end portion of the installation groove is provided with an installation hole or a protrusion, and one end of the reset spring is sleeved on the installation hole or the protrusion.

In one embodiment, the bracket can make an action of moving up and down in the installation groove, and the reset spring is longitudinally disposed between an upper end portion of the bracket and an upper end portion of the installation groove.

In one embodiment, the upper end portion of the installation groove is provided with a protrusion, and one end of the reset spring is sleeved on the protrusion.

In one embodiment, the bracket is provided with a first connection hole, the first connection hole is located at a middle end portion of the bracket, a second connection hole is provided at a corresponding location of the installation groove. The first connection hole is connected to the second connection hole by using a connector.

In the base mechanism of a floor nailing gun according, there are two roller groups, and the two roller groups are respectively connected to a left side end and a right side end of the base.

Compared with the conventional floor nailing guns, the present invention has the following outstanding and advantageous technical effects:

According to the present invention, no tool is needed in use, operations can be performed continuously in a manner of rolling on a floor, so that working efficiency is high, and working strength is low.

According to the present invention, automatic adjustment and adaptation can be performed according to a size and a specification of a floor. In this way, not only product operations are simplified, but also an application range is wide, working efficiency of a user is further improved, and working strength of a user is reduced. Because this structure has a strong adaptive capability, and can adapt to different floor specifications, a product cost is reduced.

In addition, according to the present invention, the floor nailing gun has a simple structure, works stably, and has a long service life.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
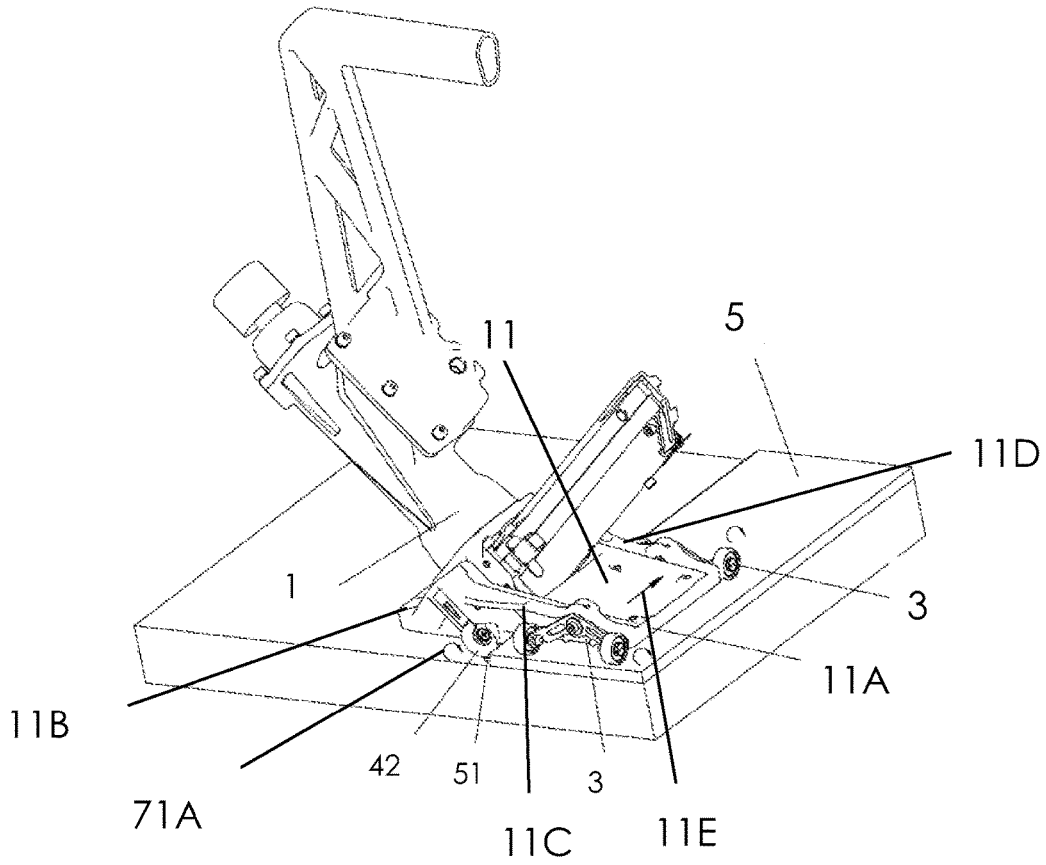
FIG. 1 shows schematically a perspective view of a base mechanism of a floor nailing gun according to one embodiment of the present invention.
Figure 2:
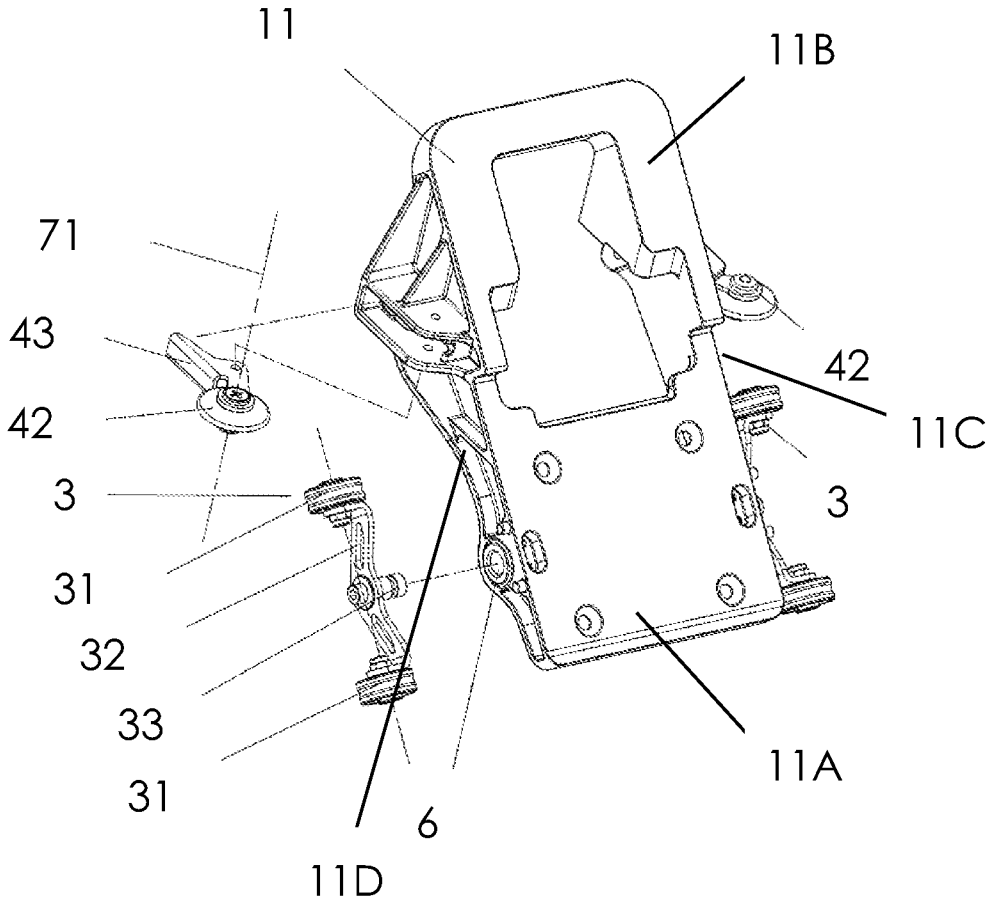
FIG. 2 shows schematically an exploded view of the base mechanism of the floor nailing gun according to one embodiment of the present invention.
Figure 3:
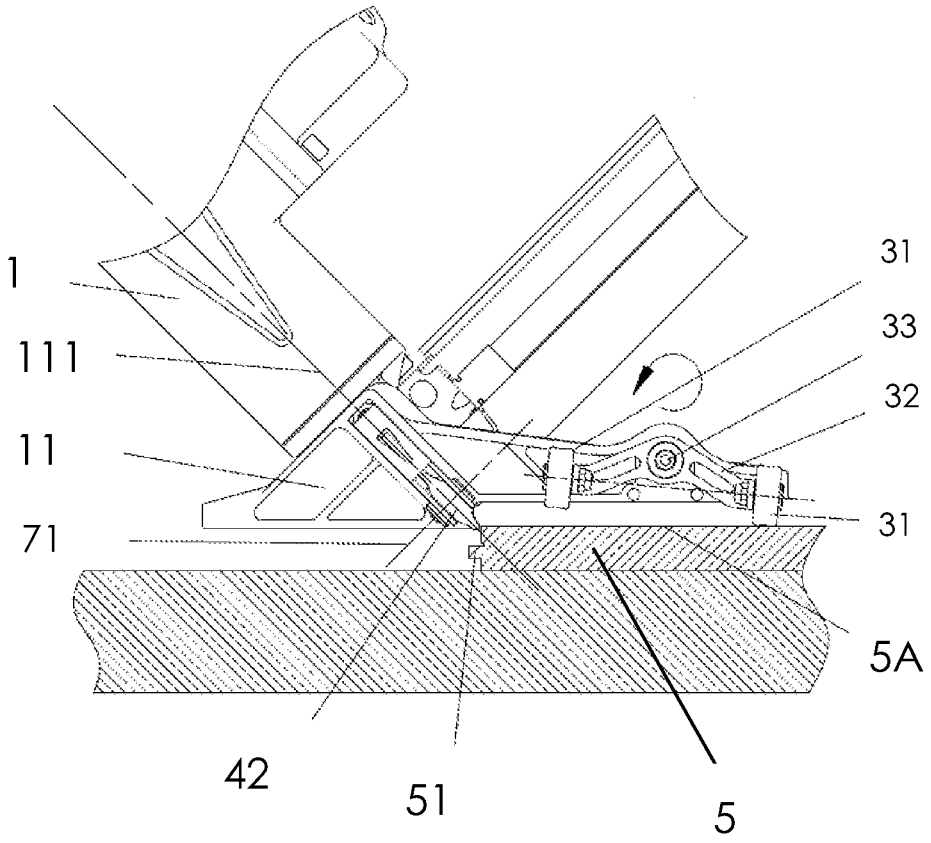
FIG. 3 shows schematically a structural diagram of the base mechanism of the floor nailing gun according to one embodiment of the present invention.

The invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom", "upper" or "top," and "front" or "back" may be used herein to describe one element's relationship to another element as illustrated in the Figures. It will be understood that relative terms are intended to encompass different orientations of the device in addition to the orientation depicted in the Figures.

For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

The description will be made as to the embodiments of the present invention in conjunction with the accompanying drawings.

Referring to FIG. 1 to FIG. 7, in one embodiment of the invention, a base mechanism of a floor nailing gun includes a base 11 fixedly connected to a bottom of a main body 1 of a floor nailing gun. The base 11 has a first end portion 11A, an opposite, second end portion 11B, a first side 11C and an opposite, second side 11D defined such that the first end portion 11A and second end portion 11B are located between the first side 11C and the second side 11D. The least one adjustment roller assembly 3 is movably disposed at the first (front) end portion 11A of the base 11. Each adjustment roller assembly 3 includes at least one adjustment roller 31 having a point in contact with an upper surface 5A of a floor board 5 and a moving direction 11E longitudinally along the floor board 5, when the at least one adjustment roller is working, i.e., in operation, and the moving direction 11E of the adjustment roller 31 is from the second (left) side 11D to the first (right) side 11C of the base 11, or vice versa.

In one embodiment, the adjustment roller assembly 3 further includes an adjustment member 32, and the adjustment roller 31 is connected to the base 11 by using the adjustment member 32.

In one embodiment, the adjustment member 32 is disposed on a bottom surface, left and right surfaces, or a front side surface of the base 11 by using a hinge pin 33, and the base 11 is provided with a sleeve 6 adaptive to the hinge pin 33.

In one embodiment, the adjustment member 32 is an adjustment connecting plate, the adjustment connecting plate is a symmetric member, and the hinge pin 33 passes through a middle portion of the adjustment connecting plate and connects to the sleeve 6.

In one embodiment, at least one adjustment roller 31 is disposed on the adjustment connecting plate.

In one embodiment, there are two adjustment rollers 31, and the two adjustment rollers 31 are symmetrically disposed at two ends of the adjustment connecting plate.

In one embodiment, at least one positioning roller 42 is disposed on a rear end portion of the base 11, and an axis 71 of the positioning roller is mutually perpendicular to an axial lead 111 of the main body of the floor nailing gun.

In one embodiment, the positioning roller 42 is installed on the base 11 by using a bracket 43.

In one embodiment, there are two positioning rollers 42, and the two positioning rollers 42 are respectively connected to a left side and a right side of the base 11.

The working principle of the present invention is: When used on floors having different specifications, one roller (the adjustment roller 31 on the right side in FIG. 3) in the adjustment roller assembly 3 first comes into contact with the floor surface 5, the other adjustment roller 31 (for example, the adjustment roller 31 on the left side in FIG. 4) on the adjustment roller assembly 3 is adjusted under the action of external force (external force is mainly a gravity of the tool) to come into contact with the floor surface 5, until all rollers on the adjustment roller assembly 3 come into contact with the floor surface 5. The adjustment roller assembly 3 is adjusted to be balanced.

Figure 4:
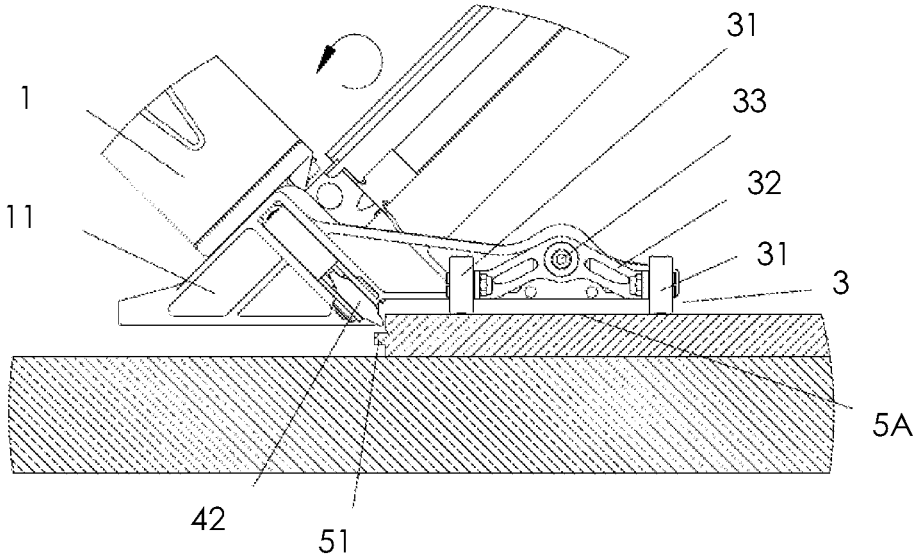
FIG. 4 shows schematically another structural diagram of the base mechanism of the floor nailing gun according to one embodiment of the present invention.
Figure 5:
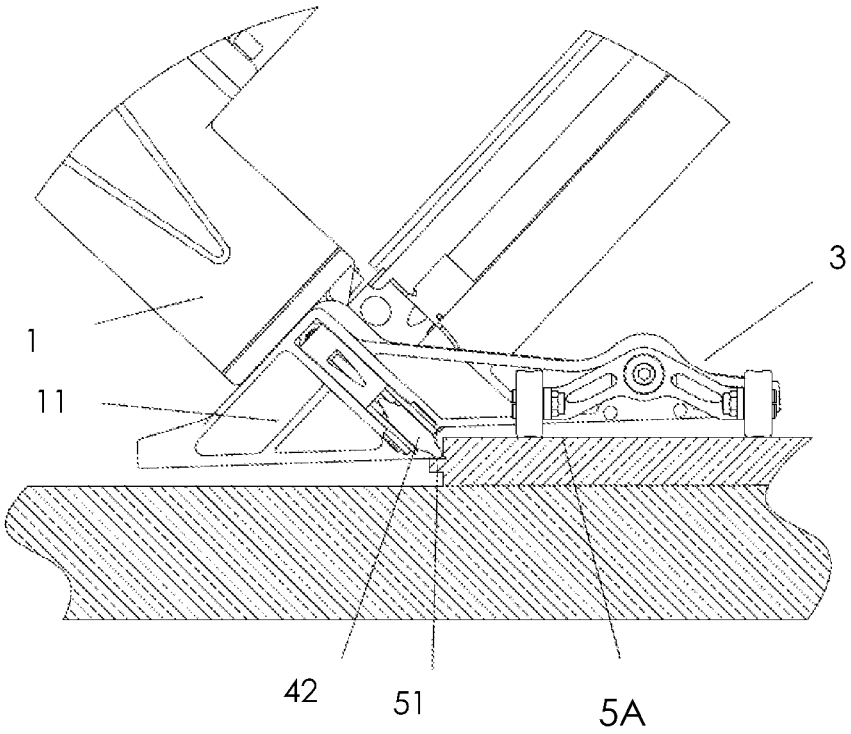
FIG. 5 shows schematically yet another structural diagram of the base mechanism of the floor nailing gun according to one embodiment of the present invention.
Figure 6:
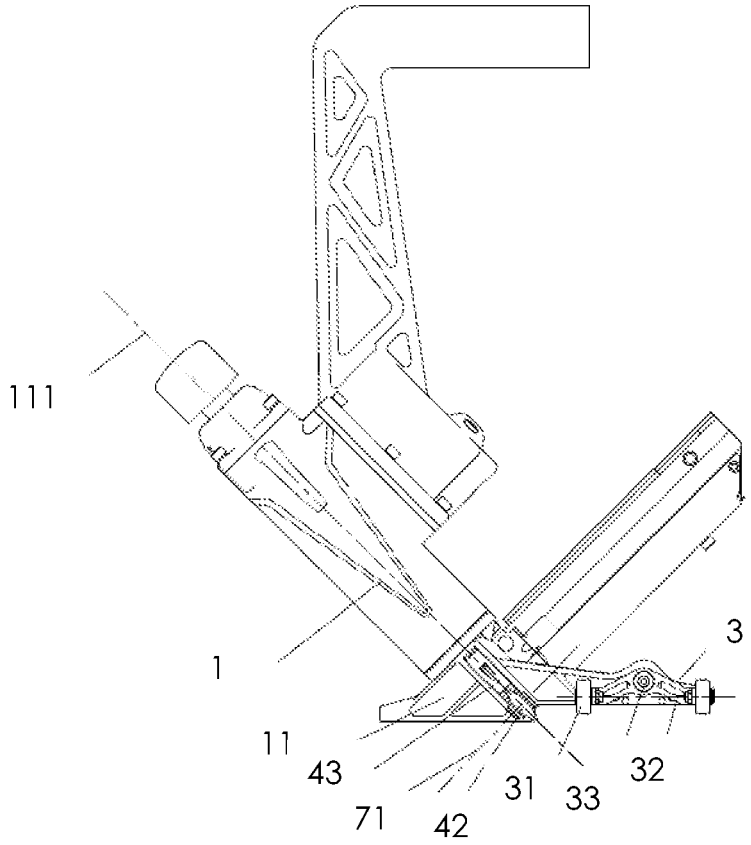
FIG. 6 shows schematically an alternative structural diagram of the base mechanism of the floor nailing gun according to one embodiment of the present invention.
Figure 7:
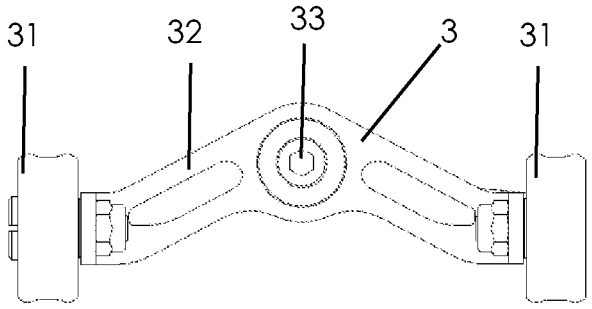
FIG. 7 shows schematically a structural diagram of an adjustment roller assembly according to one embodiment of the present invention.
Figure 8:
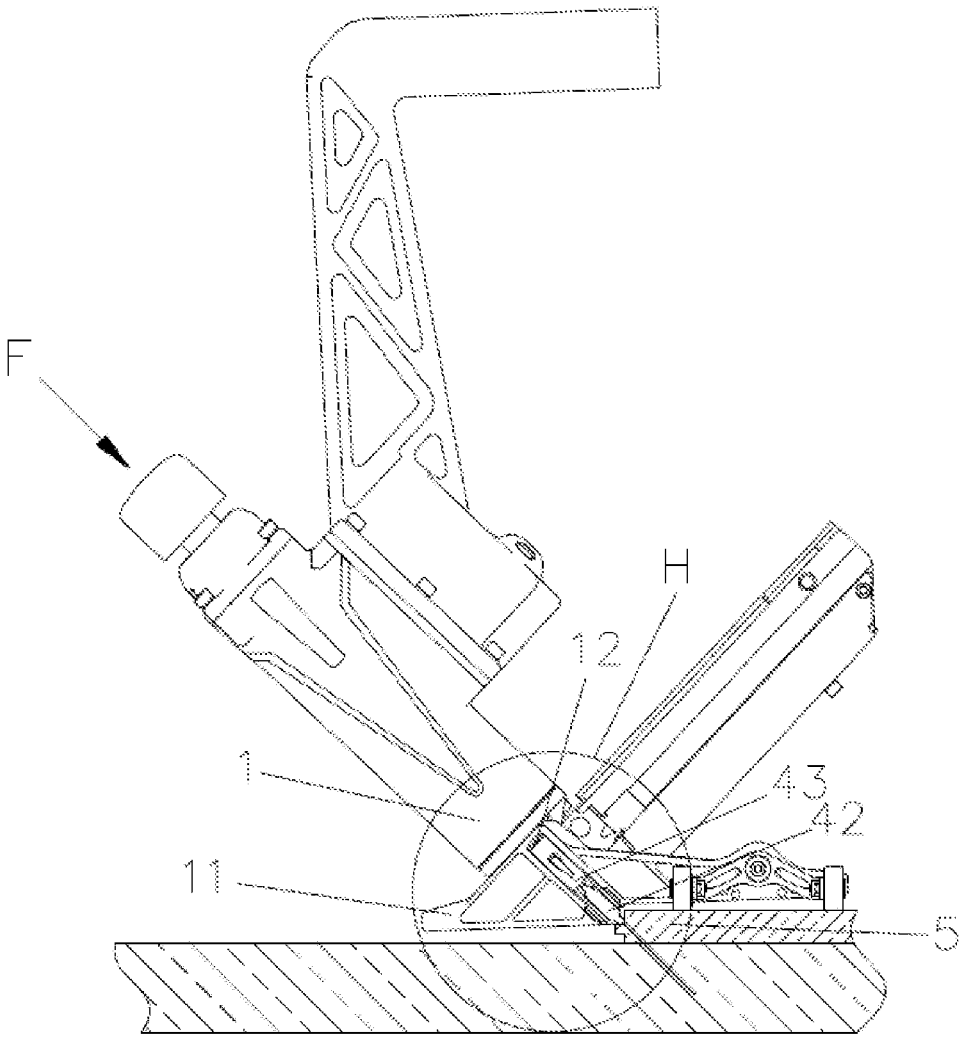
FIG. 8 shows schematically a structural diagram of a main body of a floor nailing gun having a roller mechanism according to one embodiment of the present invention.
Figure 9:
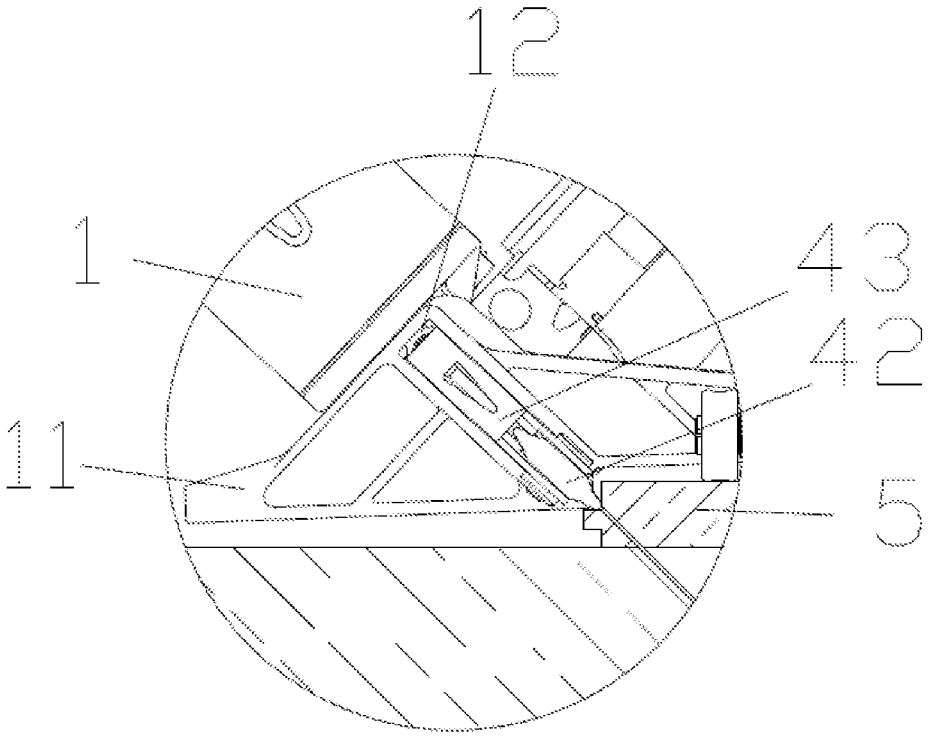
FIG. 9 shows a locally enlarged view of a portion H shown in in FIG. 8.
Figure 10:
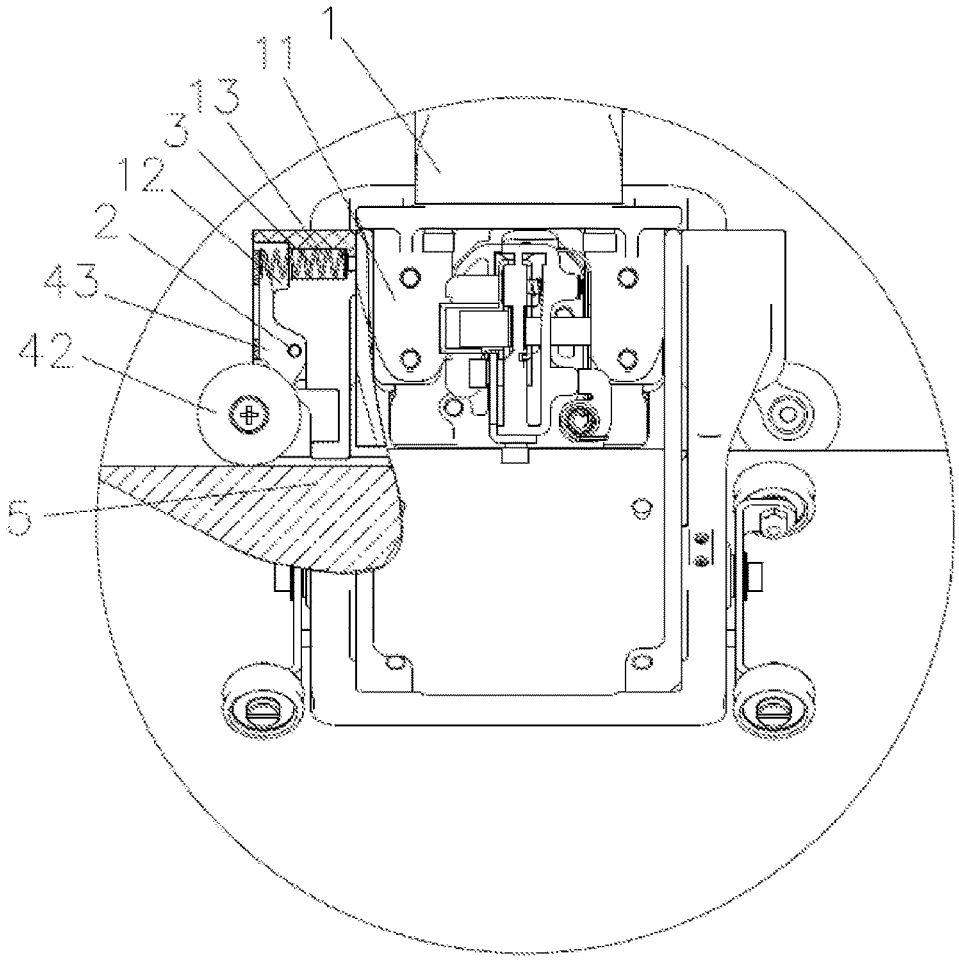
FIG. 10 shows schematically a structural diagram of a roller mechanism of a floor nailing gun according to one embodiment of the present invention.
Figure 11:
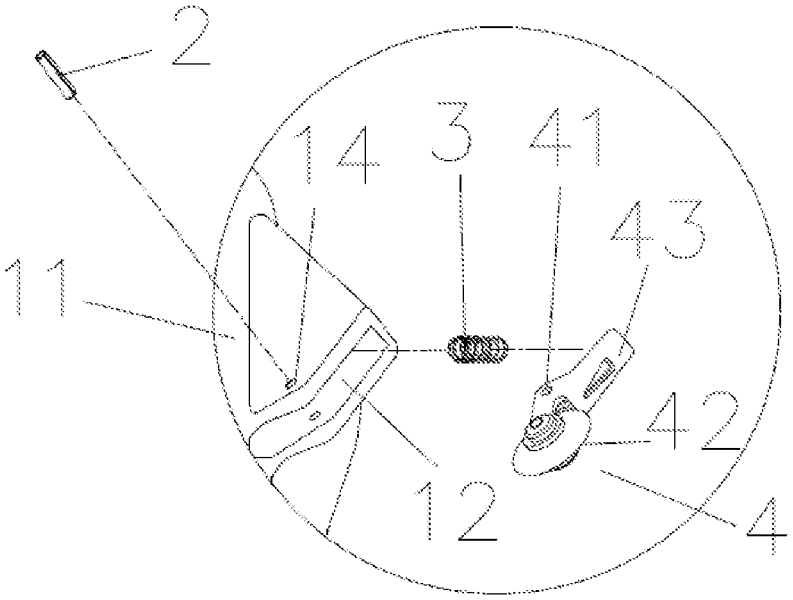
FIG. 11 shows schematically a structural diagram of a connection between a bracket and an installation groove according to one embodiment of the present invention.

In addition, in one embodiment, at least one positioning roller 42 is added in the present invention. The at least one positioning roller 42 has an axis 71 and is rotatable around the axis 71, e.g., rotatable along a rotating direction 71A, as shown in FIG. 1. In the exemplary embodiment shown in FIG. 2, the at least one positioning roller 42 includes two positioning rollers 42 that are attached/installed respectively on the first side 11C and the second side 11D of the base 11 using a bracket 43 such that the axis 71 of each positioning roller 42 is mutually perpendicular to an axial lead 111 of the main body 1 of the floor nailing gun. In operation, the positioning roller 42 is contact with a flange 51 of the floor board 5 and rotates along the flange 51 of the floor board 5, as shown in FIGS. 1 and 4-5. The two positioning rollers 42 are positioned near the second (rear) end portion 11B of the base 11. After the adjustment roller assembly 3 is adjusted to be balanced, the tool entity starts to rotate by using the hinge pin 33 in the middle of the adjustment roller assembly 3 as an axis, until positions of the positioning rollers 42 come into contact with the flange 51 of the floor board 5 (shown in FIG. 5). In this case, the tool is balanced As shown in FIG. 1, after the foregoing steps are performed, the tool in use is pushed to easily change a position to work.

It should be noted that, in the present invention, for the adjustment roller 31 on the adjustment roller assembly 3, besides that the adjustment roller 31 on the right side first comes into contact with the floor surface 5 and the adjustment roller 31 on the left side then comes into contact with the floor surface 5, which is described above, the adjustment roller 31 on the left side may further first come into contact with the floor surface 5, and the adjustment roller 31 on the right side then comes into contact with the floor surface 5; or the adjustment rollers 31 on the adjustment roller assembly 3 come into contact with the floor surface 5 at the same time, to achieve a role of adjusting the adjustment roller assembly 3 to be balanced, which mainly depends on impact of external force.

Referring to FIG. 8 to FIG. 11, in one embodiment of the invention, a roller mechanism of a floor nailing gun includes a base 11 fixedly connected to a bottom of a main body 1 of a floor nailing gun, at least one roller group 4 is disposed at a rear end portion of the base 11, an elastic reset member is disposed between the roller group 4 and the base 11, the roller group 4 includes a roller 42, and a lowest point of the roller 42 is in contact with a floor surface when the roller 42 is in a normal state.

In one embodiment, the roller 42 is movably disposed on the base 11 by using a bracket 43, and the roller 42 is disposed at a bottom of the bracket 43 in a rolling manner.

In one embodiment, the base 11 is provided with an installation groove 12, and the bracket 43 is located in the installation groove 12.

In one embodiment, the elastic reset member is a reset spring 8, the reset spring 8 is located in the installation groove 12, and one end of the reset spring 8 is connected to the base 11, and the other end is connected to the bracket 43.

In one embodiment, the bracket 43 is rotatably connected in the installation groove 12, and the reset spring 8 is transversely disposed between an upper end portion of the bracket 43 and an upper end portion of the installation groove 12.

In one embodiment, the upper end portion of the installation groove 12 is provided with an installation hole 13 or a protrusion, and one end of the reset spring 8 is sleeved on the installation hole 13 or the protrusion.

In one embodiment, the bracket 43 is provided with a first connection hole 41, the first connection hole 41 is located at a middle end portion of the bracket 43. A second connection hole 14 is provided at a corresponding location of the installation groove 12. The first connection hole 41 is connected to the second connection hole 14 by using a connector 2.

In one embodiment, there are two rollers 42, and the two rollers 42 are respectively connected to a left side end and a right side end of the base 11.

In one embodiment, the elastic reset member functions to provide, to the roller group 4, a capability of resetting to a normal state. In this embodiment, an example in which the elastic reset member is the reset spring 8 is used.

Figure 12:
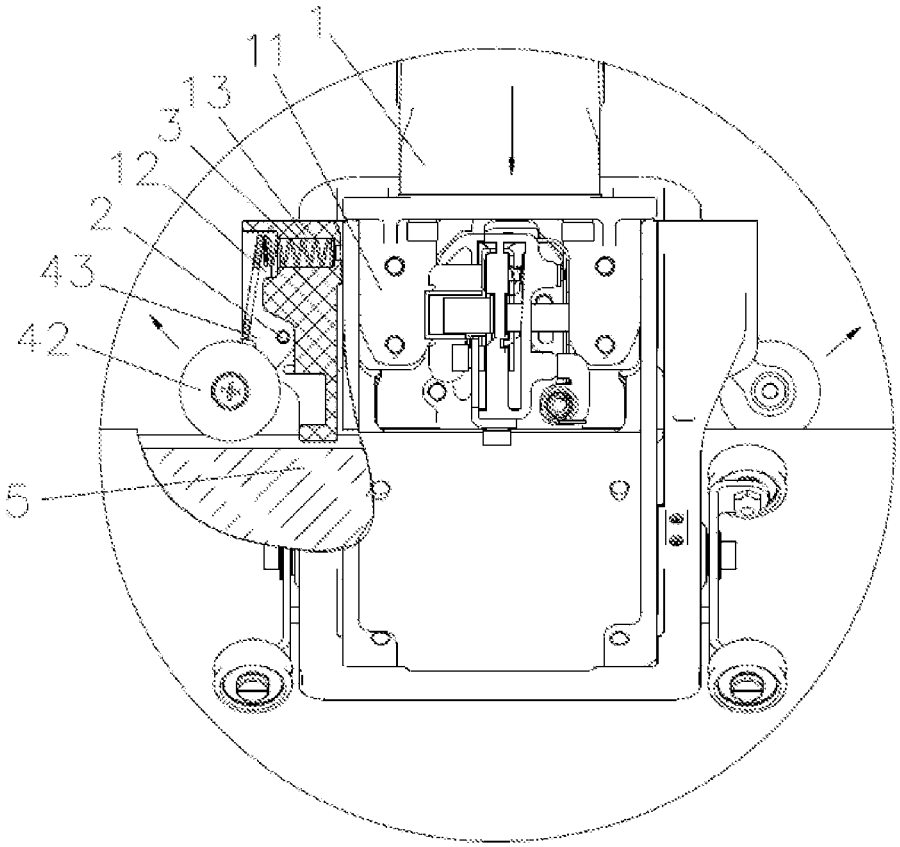
FIG. 12 shows schematically a structural diagram of exerting driving force F according to one embodiment of the present invention.

As shown in FIG. 12, the roller group 4 is in contact with a side edge of a floor 5 by using the roller 42, and rolls when the floor nailing gun moves. When the roller group 4 works, an operator exerts, on the floor nailing gun, driving force F that is fired by the floor nailing gun, and the driving force is transferred to the side edge of the floor 5 by using the roller 42.

When the force transferred to the roller 42 reaches a certain degree, while the roller group 4 rotates around the connector 2 and rolls back, the roller group 4 keeps in contact with the floor 5 under the action of the reset spring 8. The main body 1 of the floor nailing gun moves under the action of the driving force F and comes into contact with the floor 5 to directly transfer force. As the transferred force eliminates a gap between the floors 5, the transferred force drives the floor nailing gun to fire.

Figure 13:
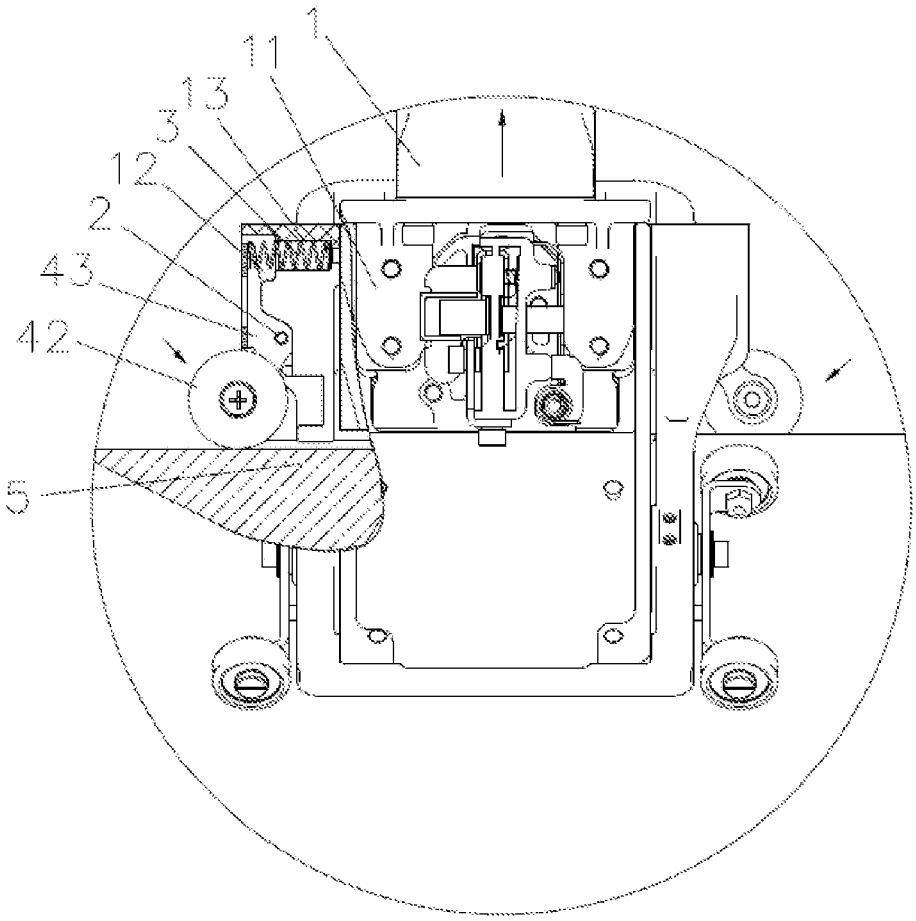
FIG. 13 shows schematically a structural diagram after the driving force F disappears according to one embodiment of the present invention.

As shown in FIG. 13, when firing is completed, the driving force F disappears, and the roller 42 rotates and moves inwards under the action of the reset spring 8. The main body 1 of the floor nailing gun falls off a side surface of the floor 5 and is no longer in contact with the side surface. Therefore, when the floor nailing gun is moved, the main body 1 of the floor nailing gun no longer rubs with the floor 5, but the roller rolls.

To achieve a phenomenon that the roller group 4 rolls back when firing is performed, so as to avoid a damage of the roller 42 caused by directly transferring the driving force F by using the roller 42, in the present invention, an object of rolling back is achieved in a manner of rotating or stretching.

Figure 14:
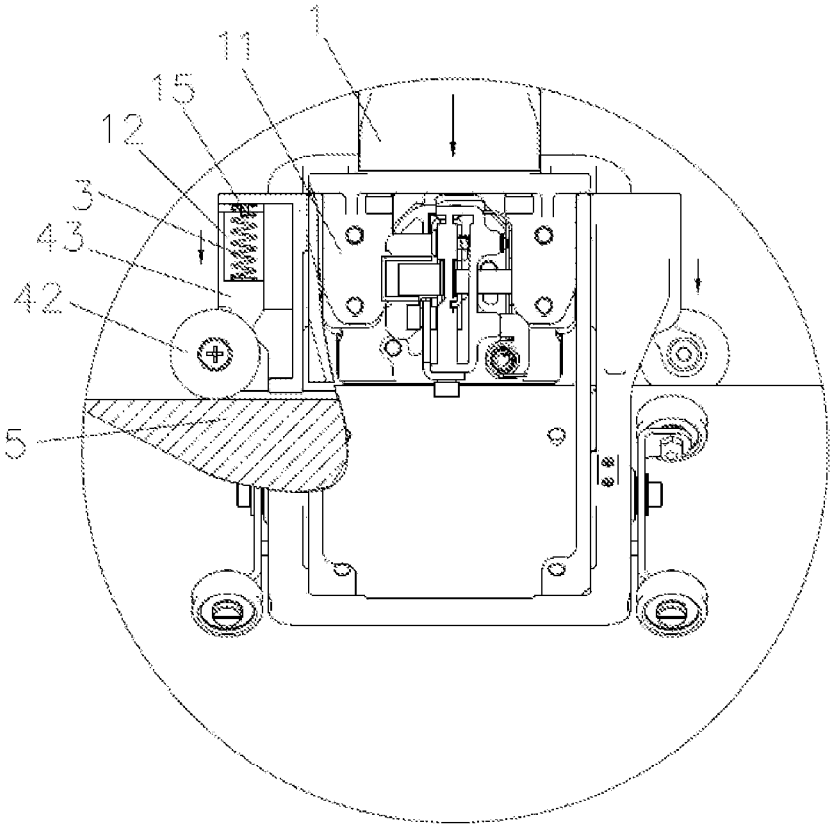
FIG. 14 shows schematically a structural diagram of exerting driving force F according to another embodiment of the present invention.
Figure 15:
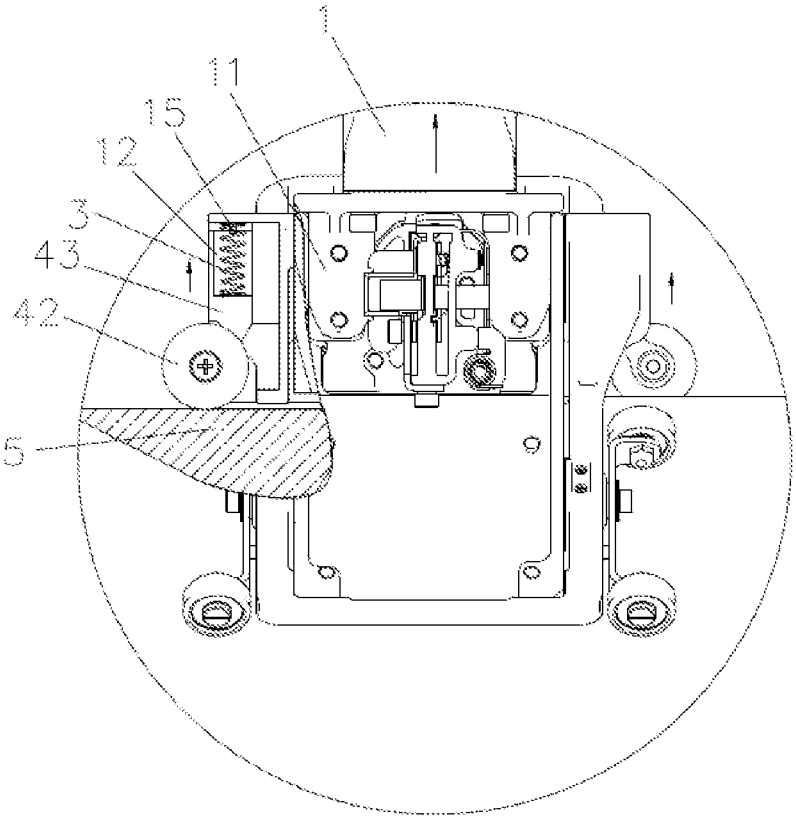
FIG. 15 shows schematically a structural diagram after the driving force F disappears according to another embodiment of the present invention.

Referring to FIG. 14 and FIG. 15, from the perspective of a structure, besides that the bracket 43 can make an action of moving up and down in the installation groove 12, the reset spring 8 is longitudinally disposed between an upper end portion of the bracket 43 and an upper end portion of the installation groove 12; except that the upper end portion of the installation groove 12 is provided with a protrusion 15, and one end of the reset spring 8 is sleeved on the protrusion 15, the rest is the same as content of Embodiment 1, and is not described herein again.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A base mechanism of a floor nailing gun, comprising:

a base fixedly connected to a bottom of a main body of a floor nailing gun, wherein the base has a first end portion, an opposite, second end portion, a first side and an opposite, second side defined such that the first end portion and second end portion are located between the first side and the second side;

at least one adjustment roller assembly pivotally connected to the first end portion of the base, wherein each adjustment roller assembly comprises at least one adjustment roller having a point in contact with an upper surface of a floor board, and a moving direction longitudinally along the floor board, when the at least one adjustment roller is in operation, and the moving direction of the at least one adjustment roller is from the first side to the second side of the base, or vice versa; and, at least one positioning roller having an axis and being rotatable around said axis, wherein the at least one positioning roller is installed on at least one of the first side and the second side of the first or second end portions of the base using a bracket such that the axis of the at least one positioning roller is mutually perpendicular to an axial lead of the main body of the floor nailing gun;

wherein the base rotates about a rotation axis of the adjustment roller assembly; and wherein when the device is in operation, the at least one positioning roller contacts a flange of the floor board due to the rotation of the base, and the positioning roller rotates along the flange of the floor board.

2. The base mechanism according to claim 1, wherein each adjustment roller assembly further comprises an adjustment member, and the at least one adjustment roller is connected to the base by using the adjustment member.

3. The base mechanism according to claim 2, wherein the adjustment member is disposed on a bottom surface, a first side surface, a second side surface, or an end surface of the first end portion of the base by using a hinge pin, and the base is provided with a sleeve adaptive to the hinge pin.

4. The base mechanism according to claim 2, wherein the adjustment member is an adjustment connecting plate, the adjustment connecting plate is a symmetric member symmetrical at a middle of the adjustment connecting plate, and the hinge pin passes through the middle of the adjustment connecting plate and connects to the sleeve.

5. The base mechanism according to claim 4, wherein the at least one adjustment roller comprises two adjustment rollers, and the two adjustment rollers are symmetrically disposed at two ends of the adjustment connecting plate.

6. The base mechanism according to claim 1, wherein the at least one positioning roller comprises two positioning rollers, and the two positioning rollers are respectively connected to the first side and the second side of the base.

7. A floor nailing gun, comprising: a base mechanism according to claim 1.

* * * * *